US006045468A

United States Patent [19]

Tinsley et al.

[11] Patent Number: 6,045,468

[45] **Date of Patent: *Apr. 4, 2000**

[54] ARROWHEAD

[76] Inventors: Greg E. Tinsley, 2292 Cannell Ave., Simi Valley, Calif. 93063; William J. Winke, R.R. 1 Box 282, Albia, Iowa 52531

[ * ] Notice: This patent is subject to a terminal disclaimer.

[21] Appl. No.: 08/794,372

[22] Filed: Feb. 4, 1997

Related U.S. Application Data

[63] Continuation of application No. 08/328,841, Oct. 25, 1994, Pat. No. 5,636,846, which is a continuation-in-part of application No. 29/001,071, Nov. 2, 1992, Pat. No. Des. 351,891.

[51] Int. Cl.[7] ..... F42B 6/08

[52] U.S. Cl. ..... 473/584

[58] Field of Search ..... 473/584, 578, 473/582, 583; D22/115

[56] References Cited

U.S. PATENT DOCUMENTS

| | | | |
|---|---|---|---|
| 2,940,758 | 6/1960 | Richter | 473/584 |
| 4,381,866 | 5/1983 | Simo | 473/584 |
| 4,504,063 | 3/1985 | LeBus | 473/584 |
| 4,565,377 | 1/1986 | Trponcoso, Jr. et al. | 473/584 |
| 5,354,068 | 10/1994 | Maleski | 473/584 |
| 5,496,043 | 3/1996 | Ester | 473/584 |

*Primary Examiner*—Jessica J. Harrison
*Attorney, Agent, or Firm*—Lawrence S. Cohen

[57] ABSTRACT

A broadhead type arrowhead having a plurality of blades mounted on a body in which the blades each have a forward facing extension which are received in openings in a tip assembly. The tip assembly has a washer having apertures in which the blade extensions are received.

11 Claims, 8 Drawing Sheets

FIG. 3
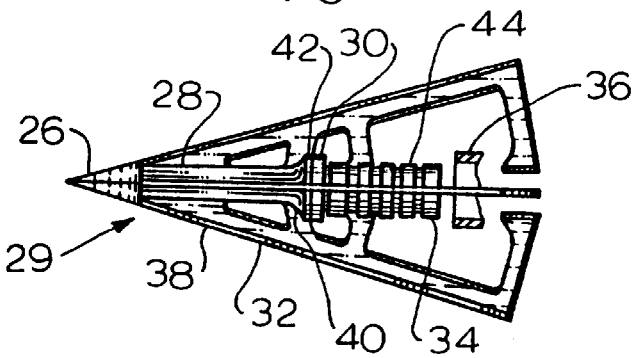
FIG. 5
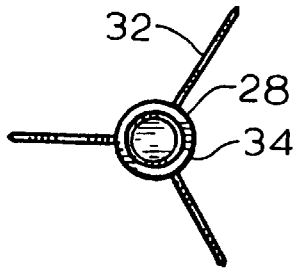
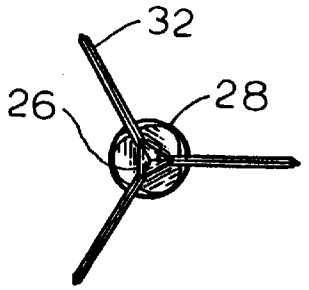
FIG. 6
FIG. 4
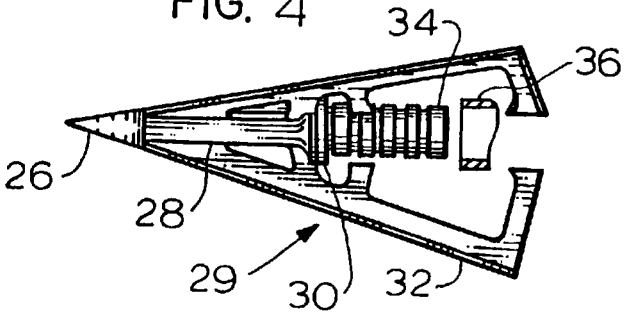
FIG. 7
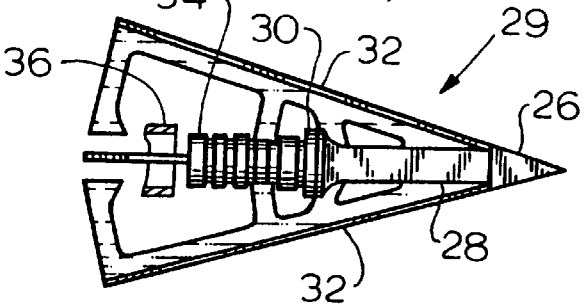

FIG. 8
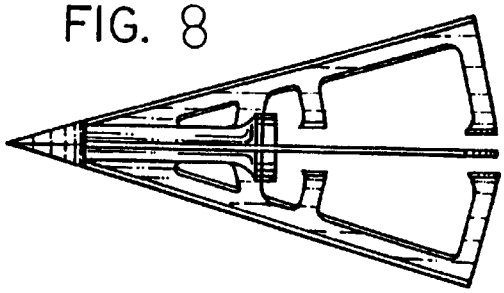
FIG. 10
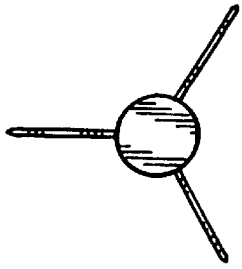
FIG. 9
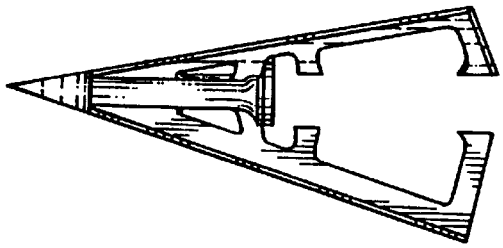
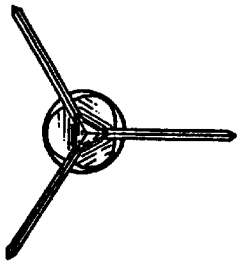
FIG. 11
FIG. 12
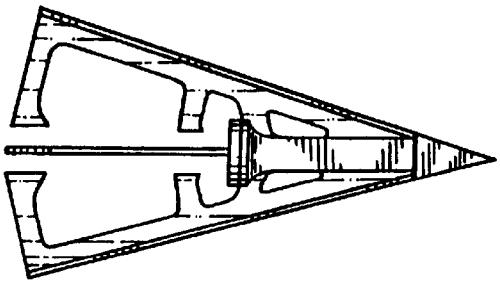

FIG. 14
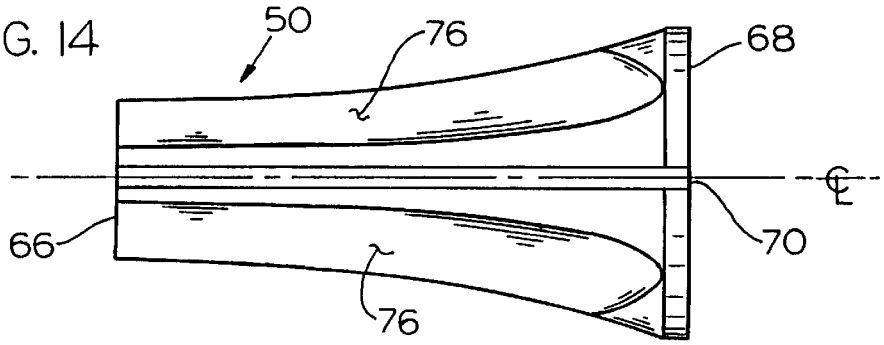
FIG. 18
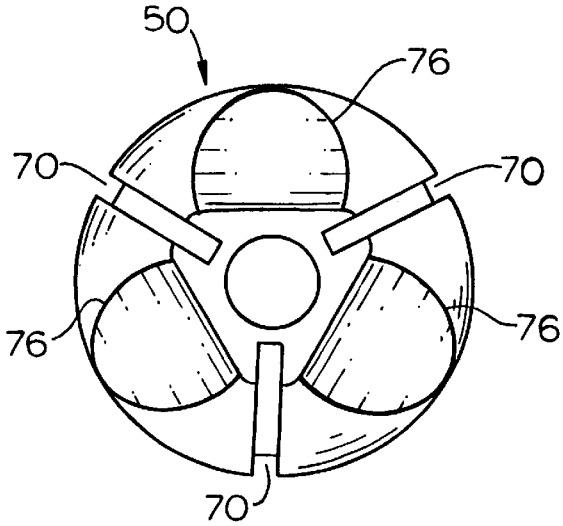
FIG. 17
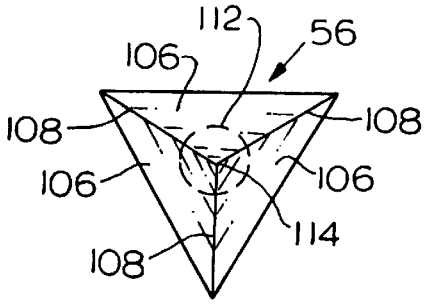
FIG. 15
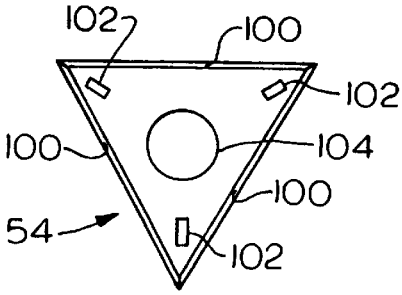
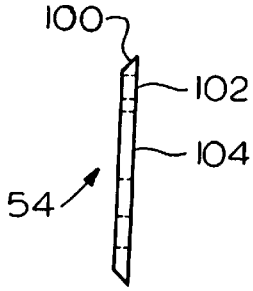
FIG. 16

ARROWHEAD

RELATED APPLICATIONS

This application is a continuation of application Ser. No. 328,841 filed on Oct. 25, 1994, now U.S. Pat. No. 5,636,846 which is a CIP of 29/001,071, filed Nov. 2, 1992, U.S. Pat. No. Des. 351,891.

BACKGROUND OF THE INVENTION

This invention relates to arrowheads of the type in which a plurality of blades are mounted on a body which is attached to the head end of an arrow. Such arrowheads are commonly referred to as broadheads. These arrowheads are used for hunting game.

Arrowheads of the present type are characterized in having a plurality of sharpened blades which are attachable to a body which body is attachable to the head end of an arrow. In the most popular construction the blades are made separately from the body and are assembled to the body before or at the time of intended use. In such cases the blades can be replaced after use if for example they are damaged during use. While the most popular construction provides for removable, replaceable blades, some configurations are made up by permanent attachment of the blade and carrying body.

Arrowheads of this type typically have thin very sharp blades whose sharpened edge extends rearwardly at an angle from the axis of the arrow. It is desirable to keep the blade angle as low as possible to reduce resistance to penetration. But, it is also desirable that the final blade height be as great as possible to provide a large wound. In the case of a given size for the body, these goals are in conflict. To resolve this conflict by increasing the length of the blade the carrying body must be increased in length, which is undesirable. It is also appreciated that the weight of the broadhead must be as low as possible, so increasing the length of the carrying body is contrary to this goal. In some configurations the blade projects in front of the carrying body, which is a limited possibility.

Broadheads are typically mounted at the head end of an arrow shaft by attachment to an insert which is firmly fitted inside the hollow shaft.

The present invention overcomes the limitations and conflicts of broadheads known in the past.

SUMMARY OF THE INVENTION

The present invention is a broadhead arrowhead which is mountable on the head end of an arrow shaft and which has a plurality of blades mounted on a body. The blades are mounted on the body prior to use. They can be replaced if damaged.

In this invention the shortcomings of prior designs are overcome. The blade is mounted on the body but unlike prior designs the length of the blade does not terminate within the length of the body in particular ahead of the arrow shaft. Instead, it extends rearwardly beyond the back end of the body; so that when mounted on an arrow shaft, a rear extension portion of the blade extends along the arrow shaft. A stabilizing portion of the blade extends to a point close to or in contact with the arrow shaft, to keep the blade from excessively flexing or bending during penetration of the target. Thus, the length of the blade is not constrained by the length of the body. The rear extension portion can extend as far over the arrow as desired with due consideration for other factors such as weight, strength and arrow flight characteristics. In this way a combination of lower penetration angle and greater blade height can be accomplished to achieve greater effectiveness in bringing down game.

The blade is attached to the body at the front by a forward tang which fits into a washer. At the rear of the body the blade is attached by a rear tang which is captured by a ring. The body has an insert fitting which fits into a commercially available arrow insert which is firmly fitted in the arrow shaft. Alternatively the insert can be made an integral part of the body, and in this embodiment it provides an added benefit of lower weight.

In an alternative construction, the broadhead can be used with a carbon type arrow shaft. In this construction, the arrow shaft fits into a tube which is part of the body, known as an outsert. This is important because the hoop strength of the carbon shafts is low and they tend to split when an insert is used.

The broadhead captures the front tang of the blades in a faired washer which has openings in it. This is an improvement over the prior art use of a countersunk point because it is less expensive to make.

Also, the tip of the broadhead is beneficially shaped as a pyramid (when a 3 blade configuration is used) so that the edges of the pyramid point of the tip rearward and align with the blade edge. This provides a continuously enlarging cutting edge from the entry of the point to the rear end of the blade.

BRIEF DESCRIPTION OF DRAWINGS

FIGS. 3–12 are the views from the parent patent of which the present patent is a continuation-in-part.

FIG. 14 is a top view of the body.

FIG. 15 is a front view of the washer.

FIG. 16 is a side view of the washer.

FIG. 17 is a front view of the tip.

FIG. 18 is a front view of the body.

MODE(S) FOR CARRYING OUT THE INVENTION

Figure 1:
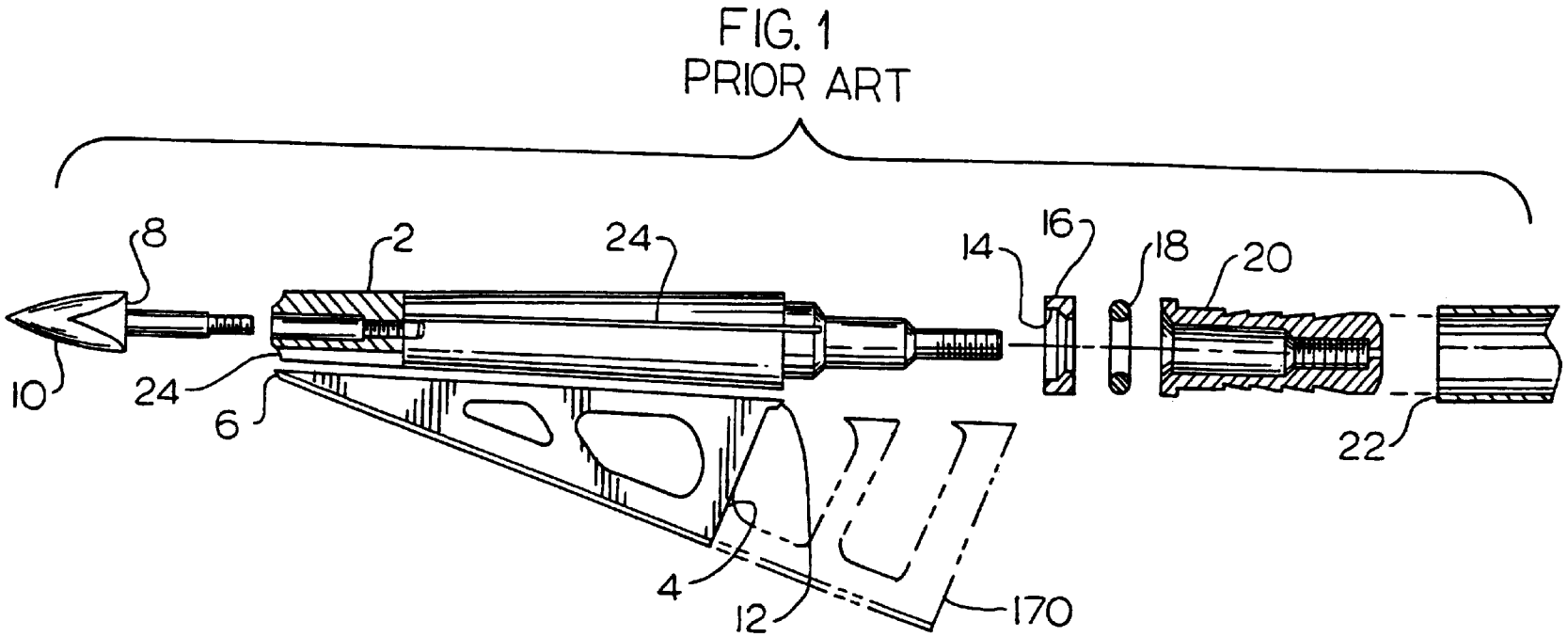
FIG. 1 PRIOR ART
FIG. 1 is an exploded partial sectional side view of an example of the prior art taken from U.S. Pat. No. 4,381,866 and added thereto in phanton lines an adaptation according to the present invention.
Figure 2:
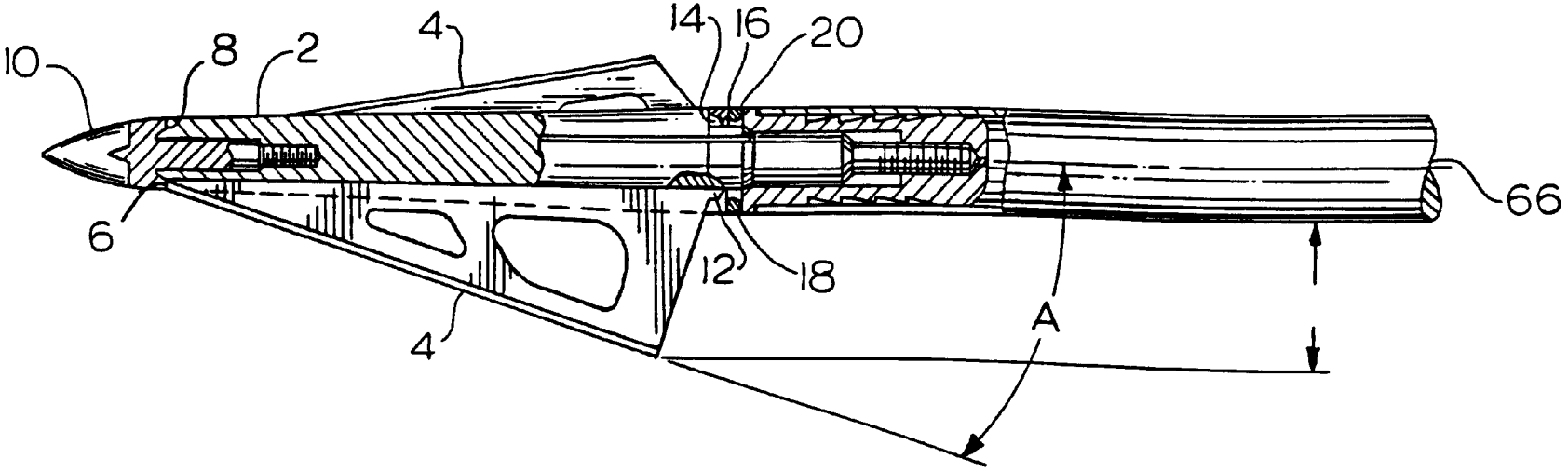
FIG. 2 PRIOR ART
FIG. 2 is a partial sectional side view of the example of FIG. 1.
Figure 19:
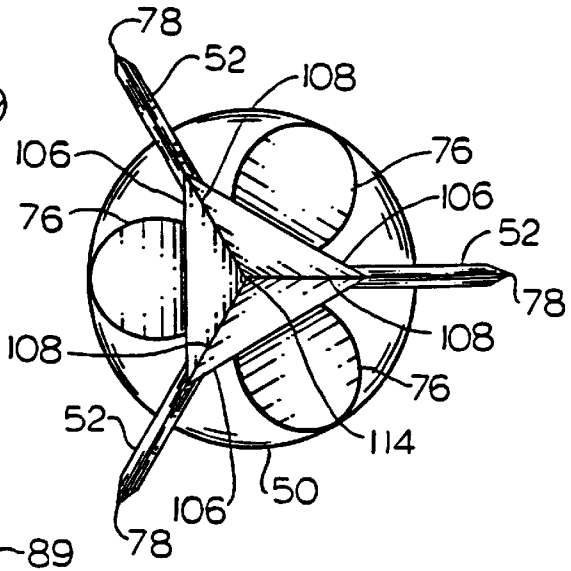
FIG. 19 is a front view of the tip, body and blades.

FIGS. 1 and 2 are an example of the prior art showing an arrowhead blade carrying body portion 2 with blades 4. The blades 4 are held in place at the forward end of the carrying body 2 by the tip forward end 6 of the blade fitting into the undercut portion 8 of the nose 10. At the rear of the blade, a rearward extending portion 12 fits into the undercut portion 14 of a locking ring 16. A compressible ring (an O-ring) 18 fits between the locking ring 16 and an insert 20. The insert 20 is pressed into the forward end of the arrow shaft 22. Thus when assembled the blade 4 is captured at its front and rear ends and sits in the slot 24. Consequently the blade length is limited by the length of the carrying body 2 and no part of it extends rearward of the head end of the arrow shaft. Referring to a product which bears the above noted patent number, the diameter is stated to be 1 3/16 and the angle A has been measured at 19¼ degrees. Therefore it appears that the height of the blade from the centerline is 19/32.

FIGS. 3 and 7 there is shown an arrowhead assembly 29 with removable blades having a rearward extension according to this invention with a pointed tip 26, body 28, rear capture ring 30, blades 32 and insert 34. An arrow shaft 36 is partially shown ready to accept the insert. FIGS. 8–12 show the arrowhead parts, tip 26, blade 32, capture ring 30 and carrying body 28.

The blade carrying body 28 is elongated along an axis which is co-extensive with the axis of the arrow shaft. Its cross section can be any convenient shape although it is desirable to reduce its size as much material as possible to reduce weight. As illustrated in FIGS. 3–12, the cross-section is triangular along most of its length at 38, expanding radially through the radius 40 to a ring 42. Rearward of the ring 42 is the insert portion 34, which has a series of circumferential rings or lands 44. Slots (not seen) run axially along the surface of the body 28. For the preferred configuration using three blades three slots 120° apart are employed preferably at the apexes of the triangular cross section. The pointed tip 26 has a triangular cross section to match that of the body 28 and having its edges aligned with the blade cutting edges. The arrow shaft 36 will be inserted over the insert 34 and will abut the capture ring 30. FIGS. 8–12 are the same as FIGS. 3–7 but omit the insert, which as will be explained below can be an independent piece.

Figure 13:
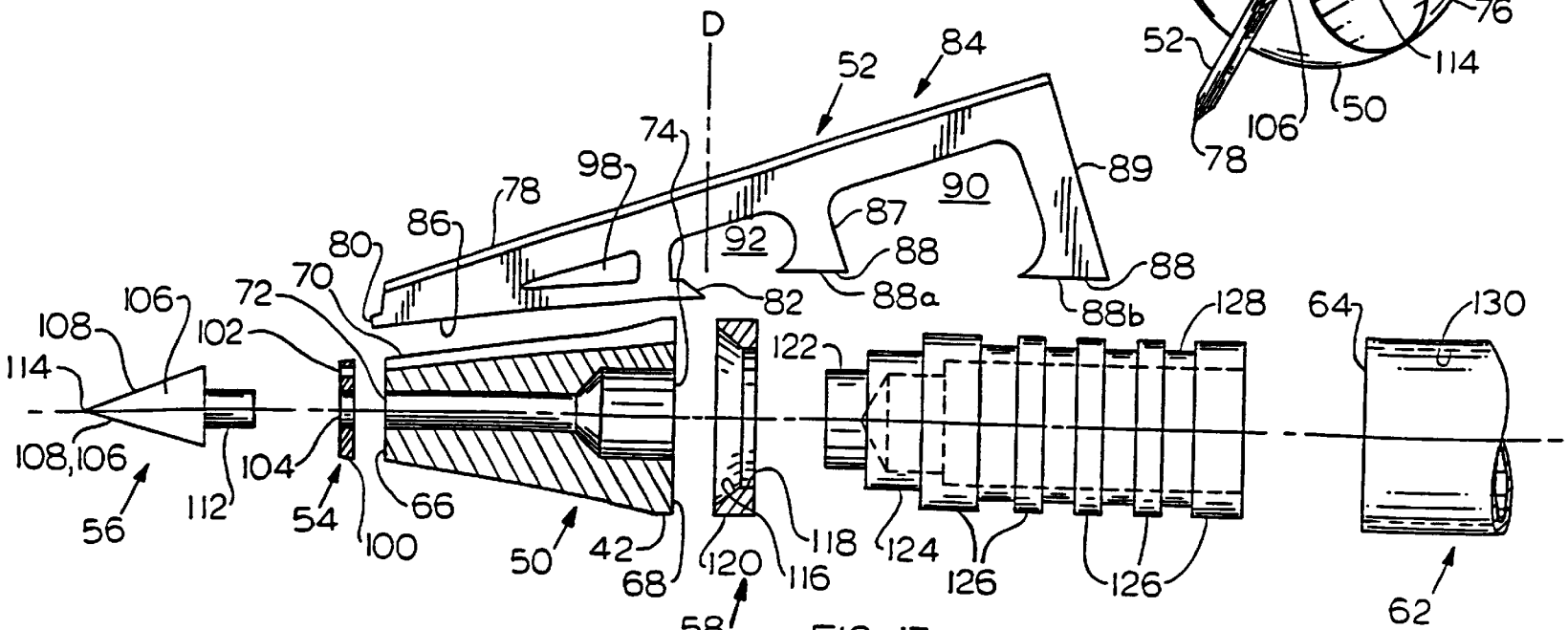
FIG. 13 is an exploded partial sectional side view of an embodiment of the invention which employs an integral insert.
Figure 21:
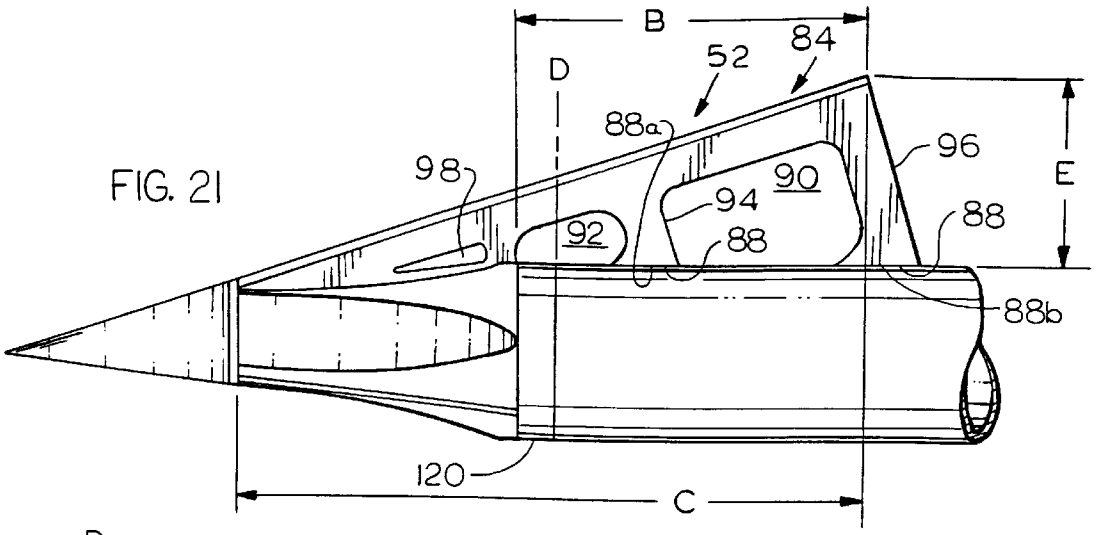
FIG. 21 is a side view of the invention mounted on an arrow shaft.

Referring to FIG. 13 there is shown an exploded partially sectional view of the broadhead along with an arrow shaft. Also FIGS. 14, 15, 16, 17, 18 and 19 show parts of the broadhead. The broadhead comprises a body 50, blades 52, a washer 54, a tip 56, a capture ring 58, and an insert 60. An arrow shaft 62 having a head end 64 is also shown.

The body 50 has a front end 66 and a rear end 68. It has a series of longitudinal slots 70 extend front to rear. It has a front bore 72 opening at the front end 66 and a bore 74 opening at the rear end 68. Although formed of a reducing circular cross section (from rear to front) it is preferably further reduced in weight by flats 76. Also weight is reduced by the front bore 72 extending through the body 50. Three blades 52 are used which are spaced 120° apart in the three slots 70. Three blades are most preferred. Two to four blades are the preferred range of blades.

Referring to FIGS. 13, 19, 20, and 21 the blades 52 have a cutting edge 78, a front tang 80, rear tang 82, and includes a rear extension portion 84 which is defined as that portion which will overlie the arrow shaft 62 when the broadhead is installed on the arrow shaft. This portion is illustrated as being rearward (to the right in the figures) of the line designated D in the figures. The blade has a lower surface 86 which will rest in the slot 70 of the body such that the tang 80 will protrude forwardly of the front end 66 and the tang 82 will protrude rearwardly of the rear end 68. The blade 52 also has a support edge 88 which is separated into two parts by removal of material at 90 and 92 to define support struts 94 and 96 which terminate in the support edges 88*a* and 88*b* respectively. Material is also removed at 98. It is desirable to form the blade by removal of as much material as possible while still preserving sufficient strength to withstand flight and contact stresses to which it will be subjected in use.

The washer 54 is angled along its outside edges 100 to meet the triangle formed by the flats 76 on the body 50. The outside edges 100 also match the surfaces of the tip 56. The washer has slots 102 formed near each apex to receive the tangs 80 of the blades 52. The washer 54 has a central hole 104.

The tip 56 is formed as a pyramid for the 3 blade configuration, having surfaces 106 which meet at edges 108. It has a rear end 110 and a shaft 112 which is sized to press fit into the bore 72. It terminates in a point 114. Alternatively the shaft 112 could be threaded and the bore 72 threaded. A press fit is better because the tip 56 should precisely align its edges 108 with the edges 78 of the blades 52. The hold 104 in the washer 54 should allow the shaft 112 to easily pass. The edges 108 provide cutting edges which along with the sharp point 114 provide improved penetration of hunted game particularly to break through bone more smoothly and penetrate more deeply than tips which have more than 3 surfaces or do not provide a continuous cutting edge from the point to the blade cutting edges. In this respect it can be appreciated that a three blade design is the best for providing penetration and strength.

The capture ring 58 has an angular bore 116 portion and a straight bore portion 118. The tang 82 of the blade 52 will fit into and be held in place by the angular bore portion 116 when the capture ring is brought into contact with the rear end 68 of the body 50. The circumference 120 matches the circumference of the arrow (see FIG. 20). Also, the rear end of the body is formed to have a circumference which matches the circumference 120 of the capture ring 58.

As seen in FIG. 13, the insert 60 has a press fit stub 122 which will press fit into the bore 74 to form an integral unit with the body 50. Behind the stub 122 is a shoulder 124 which freely fits into the bore 118 of the capture ring 58. The insert then comprises a series of lands 126 and grooves 128 the lands 126 having a diameter to fit into the arrow 62. A press fit on the inside circumference 130 is desirable, but glue can be used either as the primary holding means or to aid in holding. The shoulder 124 is longer than the width of the capture ring 58 so that the capture ring 58 can move axially an amount sufficient to allow the tang 82 to drop into position and be captured. Then the arrow shaft head end is abutted into contact to press the capture ring between the head end 64 and the rear end 68 of the body.

Figure 20:
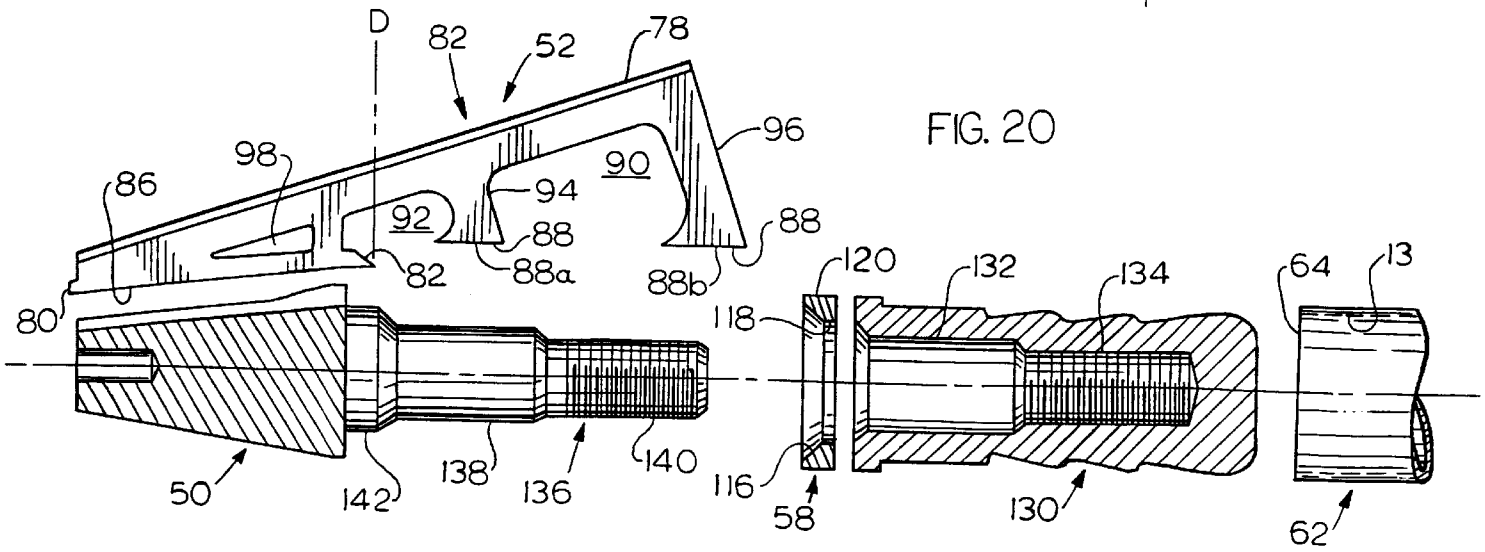
FIG. 20 is an exploded partial sectional side view of an embodiment of the invention which employs a separate insert.

An alternative embodiment is shown in FIG. 20. In this case the body 50 is adapted to secure to a separate insert 130 which is fitted inside the arrow. This type of insert has a bore 132 and threads 134. Therefore, the body 50 has a stub 136 which has a shaft 138 and a threaded rod 140. These are thread attached into the insert. The stub 136 also has a shoulder 142 which carries the capture ring 58. In some cases the insert will have an external lip such as seen in FIG. 1, in which case the abutment will be between the external lip and the capture ring, but as the term head end is used here it is intended to define either configuration.

To assemble the broadhead for use; it is noted that the washer 54 and the tip 50 will preferably be factory installed. Each blade 52 is inserted into its slot 70 and the tang 80 into its slot 102 in the washer. Then the capture ring 58 is moved forward to cover the tang 82. When this is done for all blades the assembly is mated with an arrow shaft 62 such that the head end 64 will contact the capture ring 58. The rear extension portion 84 will then project over the arrowshaft, as can be best seen in FIG. 21 with the struts 94 and 96 having their support edges 88*a* and 88*b* preferably touching, or very close to the arrow shafts outer surface.

The insert 130 can be selected from commercially available inserts, the particular form of which is selected by the user.

Figure 22:
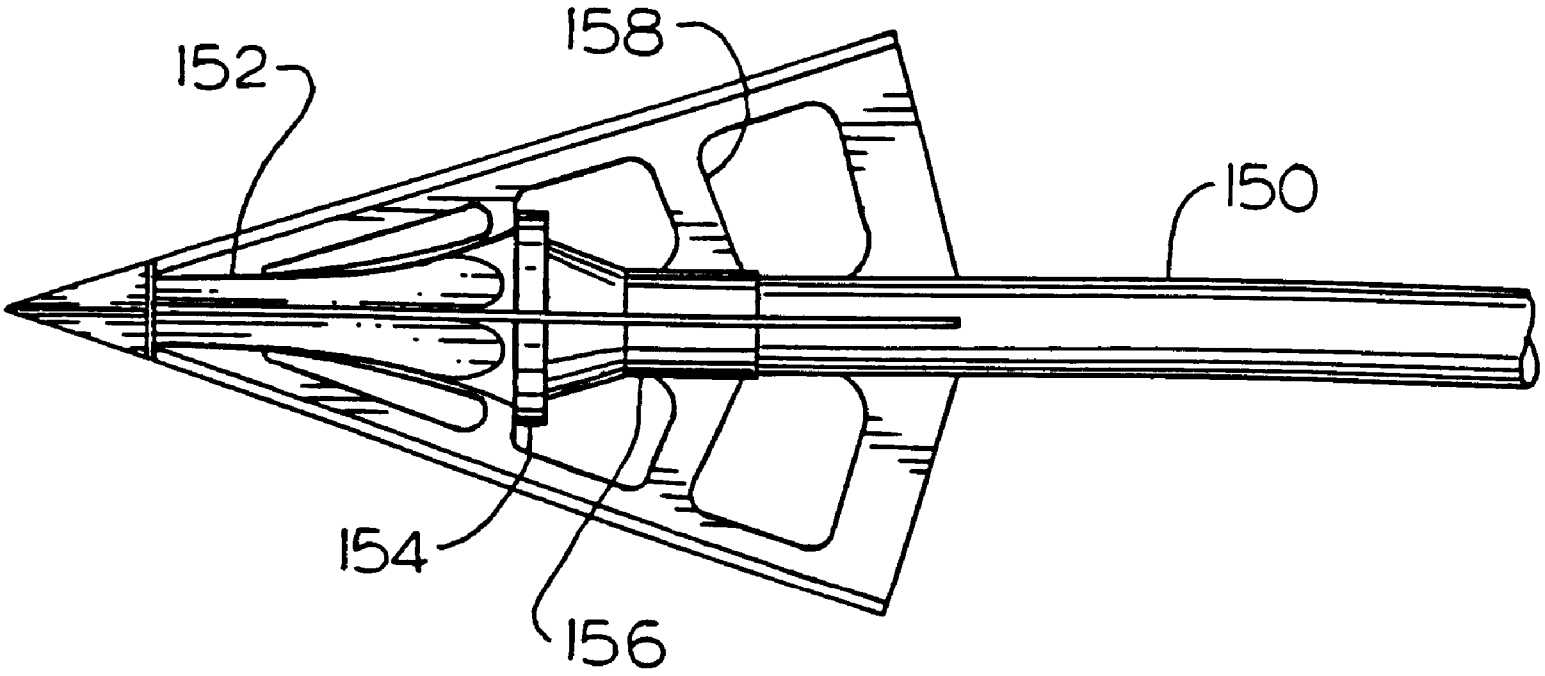
FIG. 22 is a side view of an embodiment of the invention for use with a carbon arrow.

An alternative embodiment is shown in FIG. 22 for use with a "carbon" arrow 150. These arrows are smaller in diameter. In this embodiment, the body 152 has the same basic design as described previously. There is an internally threaded blade locking ring 154 which will thread onto external threads (not seen) on the body 152. Also an integral part of the body is an outsert 156 which slides over the carbon arrow shaft 150. In one configuration the outsert 156 is slotted where the front strut 158 is positioned so that the front strut 158 contacts the arrow surface. However, the front strut 158 could contact the outside circumference of the outsert 156. This embodiment employs an outsert which is integral with the arrowhead. However, a separate outsert could be applied to the arrowshaft.

The preferred thickness of the blades 52 is 0.310 inch which is thicker than any other blade known in the field. This thicker blade provides greater strength and is made possible by weight reduction in other areas such as use of a shorter body. In particular, it will be appreciated that with the above described configuration the body length no longer dictates entry angle and blade height. Therefore, its length can be reduced. In the embodiment shown in FIG. 13 a weight of about 125 grains is contemplated. This will provide a blade angle of 18.4° and a maximum blade height over the centerline of 0.75 inches (or 1.5 inch diameter). Also, the blade length on an exemplary form of the invention is $1\frac{15}{16}$ inch versus $1\frac{3}{8}$ on a well known commercially available product. That product has a body length measured at $1\frac{13}{32}$ inch versus $\frac{7}{8}$ inch (measurement taken from front end 66 to rear end 68) on the exemplary model the blade extends a distance of 1 inch behind the head end of the arrow shaft. Thus a given blade height can be achieved at a lower angle which improves penetration. It is preferred that at least about half the total length of the blade is behind its rear support in the body. That is, referring to FIG. 21, dimension B is at least about ½ dimension C. In the exemplary case C equals $1\frac{7}{8}$ and B equals $\frac{15}{16}$. In the exemplary case, E equals $\frac{9}{16}$. These preferred dimensions about give good performance with good structural integrity. Further by extending as much of the blade as possible behind the body, using the body as a load support for the blades, the mass weight of the head is reduce. Reducing the mass weight of the arrows while maintaining a large cutting diameter and low slope is an extremely desirable combination.

The flattened trajectory of a lighter arrow improves accuracy and therefore the percentage of mortal hits when game is encountered over broken terrain at distances that are "calculated" quickly by a bowhunter's depth perception.

Reducing the length of the tip and body also increases its strength. This is very desirable especially when dense bone must be shattered or cut through in order to penetrate and strike vital organs. Often conventional broadhead blades will strip from the body, or break when hitting bone. The present invention reduces the likelihood of breakage by enabling use of a thicker blade and providing the added load bearing struts 94 and 96 in addition to the load bearing features of the blade on the body and the front tang 80 and the rear tang 82.

It is noted that the arrow shaft is very strong, at 100,000 psi. This provides a very strong foundation under the struts 94 and 96. Also, the fact that the struts 94 and 96 are not contained laterally allows the blade to flex laterally when side forces are encountered such as encountered when piercing bore.

The present invention further improves arrow balance. Conventional broadheads protrude outward from the head end of an arrow as much as one-third further than the present construction. The present configuration beneficially effects the front-of-center balance of the total arrow and the arrows paradox as it is loaded by the bowstring, bends away from the bow and straightens in flight. Also, the present configuration has flight characteristics closer to the practice arrow/head combination used by bowhunters for practice. Thus the practice experience is more closely replicated in hunting use.

The blade principle in the present invention of extending a rear extension portion over and supported on the arrow shaft can also be applied to broadheads made by other manufacturers. In such case, that part of the blade which is required to be fixed to the body of the broadhead will be configured to do so conforming to the manufacturers design while a rear extension portion will be provided to extend over the arrow shaft and to abut it as described. Therefore, it is contemplated that a blade with a rear extension portion can be readily designed to fit a wide variety of replaceable blade broadheads on the market presently or in the future. Such configurations will employ the primary holding means required of their design plus the rear extension portion of the present invention. This can be readily appreciated by noting the blade configuration of FIG. 1 with the rear extension portion add-d in broken lines at 170.

Although the present invention has been described with reference to preferred embodiments, numerous modifications and rearrangements can be made with the equivalent result still embraced within the scope of the invention.

What is claim:

1. An arrowhead of the type having an elongated blade carrying body in which a plurality of blades are removably mounted, said body having a forward end and a back end, said body being mountable to the head end of an arrow shaft and having means for retaining blades, said retaining means compromising a forward facing tang on each of said blades, and a washer adjacent the adjacent forward end of said body, said washer having a laterally bounded receiving aperture aligned with each said tang in which each said tang is received so that the washer is angularly indexed to a position determined by the co-action of said tangs and said apertures.

2. The arrowhead of claim 1 further comprising a tip element attached to said body forwardly of said washer whereby said washer is placed between said tip element and said body.

3. The arrowhead of claim 3 wherein said tip element is shaped to provide a plurality of surfaces which extend from a common vertex at a front end of the tip element said surfaces widening to a rear end of the tip element and said surfaces intersect with adjacent said surfaces to define an intersecting edge extending in an axially straight line from the front to the rear of the tip and said washer has edges extending from a front to a rear of said washer which are aligned with the edges of the tip at its front end and with the blades at its rear end.

4. The arrowhead of claim 3 wherein said continuation is substantially linear.

5. The arrowhead of claims 3 wherein said laterally bounded receiving aperture indexes said washer to align said edges of said washer with said blades.

6. The arrowhead of claim 2 wherein said tip element is formed by intersecting surfaces extending from a common vertex to define a point and widening rearwardly to define edges extending from the point rearwardly and which terminates at a rear end of the tip in a cross section shape defined by the termination point of said surfaces and said edges and said washer is shaped to have front cross section shape which substantially mates with said tip cross section shape and is so shaped to have edges which extend as a continuation of said edges of said tip to also substantially align with said blades to form a substantially continuing edge from the tip of the point to the blade.

7. The arrowhead of claim 6 wherein said continuation is substantially linear.

8. The arrowhead of claim 6 wherein said laterally bounded receiving aperture indexes said washer to align said edges of said washer with said blades.

9. The arrowhead of claim 2 wherein said tip forms a pyramid shape having three or more flat surfaces which intersect defining edges of the tip extending from common vertex at a front point to a rear termination of said tip and said washer has a peripheral shape to form edges which are substantially aligned with said edges of said tip at a front end of said washer and extend rearwardly across the thickness of said washer to be substantially aligned with said blades at a rear end of said washer to form a substantially continuing edge from the tip of the point to the blade.

10. The arrowhead of claim 9 wherein said continuation is substantially linear.

11. The arrowhead of claim 9 wherein said laterally bounded receiving aperture indexes said washer to align said edges of said washer with said blades.

* * * * *